US012195688B2

(12) United States Patent
Berkebile et al.

(10) Patent No.: US 12,195,688 B2
(45) Date of Patent: Jan. 14, 2025

(54) SURFACE CONDITIONING WITH CYCLOALKANE CARBOXYLIC ACIDS AS ADDITIVES FOR WEAR PROTECTION

(71) Applicants: Northwestern University, Evanston, IL (US); U.S. Army Research Laboratory, Adelphi, MD (US)

(72) Inventors: Stephen Berkebile, Havre De Grace, MD (US); Harry D. Wise, Buffalo Grove, IL (US); Tobias Vela Martin, Evanston, IL (US); Qian Wang, Evanston, IL (US); Yip-Wah Chung, Wilmette, IL (US); Zaid Ali Subhi Al Hassan, Norridge, IL (US)

(73) Assignees: Northwestern University, Evanston, IL (US); U.S. Army Research Laboratory, Adelphi, MD (US)

( * ) Notice: Subject to any disclaimer, the term of this patent is extended or adjusted under 35 U.S.C. 154(b) by 0 days.

(21) Appl. No.: 18/507,758

(22) Filed: Nov. 13, 2023

(65) Prior Publication Data

US 2024/0287404 A1 Aug. 29, 2024

Related U.S. Application Data

(60) Provisional application No. 63/425,426, filed on Nov. 15, 2022.

(51) Int. Cl.

| | |
|---|---|
| ***C10M 129/46*** | (2006.01) |
| ***C10M 101/02*** | (2006.01) |
| *C10N 40/20* | (2006.01) |

(52) U.S. Cl.

CPC ..... *C10M 129/46* (2013.01); *C10M 101/02* (2013.01); *C10M 2203/1025* (2013.01); *C10M 2207/121* (2013.01); *C10N 2040/246* (2020.05)

(58) Field of Classification Search

CPC ..... C10M 129/46; C10M 101/02; C10M 2203/1025; C10M 2207/121; C10M 169/04; C10N 2040/246

See application file for complete search history.

(56) References Cited

U.S. PATENT DOCUMENTS 7,635,669 B2 * 12/2009 Culley ..... C10L 1/1881 508/519

11,639,482 B2 5/2023 Chung et al.

(Continued)

OTHER PUBLICATIONS

Hongxing Wu et al., "Formation and Nature of Carbon-Containing Tribofilms," *ACS Appl. Mater. Interfaces* 2019, 11, 16139-16146.

(Continued)

*Primary Examiner* — Cephia D Toomer

(74) *Attorney, Agent, or Firm* — Bell & Manning, LLC

(57) ABSTRACT

Methods of pre-conditioning and lubricating the rubbing surfaces of steel substrates are provided. The methods include a pre-conditioning step in which a hydrocarbon fluid having cycloalkane carboxylic acid additives dispersed therein is used to form a tribofilm on a rubbing surface of a device, following by replacing the pre-conditioning lubricant with a cycloalkane-carboxylic acid-free hydrocarbon lubricant for the regular operation of the device. The tribofilm formed during the pre-conditioning step provides long-term friction and wear reduction at the rubbing surfaces, even after it is replaced, and allows for the subsequent operation of the device without the need to change the composition of the regularly used lubricant.

17 Claims, 13 Drawing Sheets

(56) References Cited

U.S. PATENT DOCUMENTS

| | | | | |
|---|---|---|---|---|
| 11,781,195 | B2 * | 10/2023 | Chung | C21D 1/60 148/279 |
| 2017/0306258 | A1 * | 10/2017 | Wang | C10M 129/32 |
| 2019/0367832 | A1 * | 12/2019 | Chung | C10M 133/06 |

OTHER PUBLICATIONS

Khai K. Huynh et al., "Tribocatalysis Induced Carbon-Based Tribofilms—An Emerging Tribological Approach for Sustainable Lubrications," *Lubricants* 2023, 11 327. https://doi.org/10.3390/lubricants11080327.

Diana Berman et al., "Achieving Ultralow Friction and Wear by Tribocatalysis: Enabled by In-Operando Formation of Nanocarbon Films," *ACS Nano* 2021, 15, 18865-18879.

Blake Johnson et al., "Direct Formation of Lubricious and Wear-Protective Carbon Films from Phosphorus- and Sulfur-Free Oil-Soluble Additives," Tribology Letters (2018), 66:2; pp. 1-13. https://doi.org/10.1007/s11249-017-0945-2.

Ardian Morina et al., "Tribofilms: aspects of formation, stability and removal," *J. Phys. D: Appl. Phys*., 40 (2007) 5476-5487.

Kim Khai Huynh et al., "Tribo-induced catalytically active oxide surfaces enabling the formation of the durable and high-performance carbon-based tribofilms," *Tribology International* 184 (2023) 108476.

Arman Mohammad Khan et al., "Relating Tribological Performance and Tribofilm Formation to the Adsorption Strength of Surface-Active Precursors," Tribology Letters (2020), 68:6 https://doi.org/10.1007/S11249-019-1249-5.

Xiaojing Fu et al. "Superlubricity achieved with TiN coatings via the in situ formation of a carbon-based film at the sliding interfaces," *Ceramics International* 47.23 (2021): 33917-33921.

STLE Tribology Frontiers Conference, Nov. 12-15, 2023, Preliminary Technical Program, Cleveland Marriott Downtown at Key Tower, Cleveland, OH www.stle.org/tribologyfrontiers.

Qiang Ma et al., "Dependence of Tribological Performance and Tribopolymerization on the Surface Binding Strength of Selected Cycloalkane-Carboxylic Acid Additives," Tribology Letters (2020) 68:86 https://doi.org/10.1007/s11249-020-01329-2.

* cited by examiner

Friction Traces

Dodecane+5% CPCa on 52100 Steel-30 min Split Tests

| | |
|---|---|
| Group | C |
| Material | 52100 |
| Duration (min) | 30 |
| Concentration | 5 |
| Conditioning | Yes |

Friction Traces

Wear Results – D2 Steel and the Effect of CPCa Enabled Protection Film

Results – Raman Spectra

SURFACE CONDITIONING WITH CYCLOALKANE CARBOXYLIC ACIDS AS ADDITIVES FOR WEAR PROTECTION

CROSS-REFERENCE TO RELATED APPLICATIONS

The present application claims priority to U.S. provisional patent application No. 63/425,426 that was filed Nov. 15, 2022, the entire contents of which are incorporated herein by reference.

REFERENCE TO GOVERNMENT RIGHTS

This invention was made with government support under W911NF2020292 awarded by the Army Research Laboratory (ARMY/ARL). The government has certain rights in the invention.

BACKGROUND

In a mechanical system with components under contact and rubbing, lubrication is used to reduce friction and wear. Usually, the lubricant is a base oil that contains additives that help form a lubricious, wear-reducing polymeric protection layer (tribofilm) in situ. Cyclopropane carboxylic acid (CPCa) is an example of an additive that is known to enhance carbon tribopolymer generation in hydrocarbon lubricants. For example, tribotests have shown that polyalphaolefin-4 (PAO4) base oil containing 2.5 wt. % CPCa on high hardness 52100 steel forms a wear-reducing tribopolymer film. It is proposed that the CPCa adsorbs to the steel surface and the metastable cyclopropane ring opens due to asperity contact shear stress, resulting in the fragmentation and re-polymerization of the hydrocarbons. An eight-fold reduction of wear volume and a steady state coefficient of friction has been observed. (Hongxing Wu et al., *ACS Applied Materials & Interfaces* 2019 11 (17), 16139-16146.)

However, in some systems, the lubrication must be done with a fluid, such as a fuel, without additives, which means that the lubricant's ability to form a wear-reducing surface protection layer is low.

SUMMARY

Methods of pre-conditioning and lubricating the rubbing surfaces of steel substrates are provided.

One embodiment of a method of lubricating a steel surface, includes the steps of: applying a composition comprising a cycloalkane carboxylic acid dissolved in a hydrocarbon fluid lubricant to a steel rubbing interface between a first steel surface and a second steel surface; rubbing the first steel surface against the second steel surface at the rubbing interface for a pre-conditioning period, whereby a tribofilm is formed via dissociation of the hydrocarbon into fragments and subsequent re-polymerization of the fragments; flushing the rubbing interface using a cycloalkane carboxylic acid-free hydrocarbon for a flush period; and subsequently resuming the rubbing of the first steel surface against the second steel surface in the presence of the cycloalkane carboxylic acid-free hydrocarbon for a period of operation lasting at least 60 minutes Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings, wherein like numerals denote like elements.

DETAILED DESCRIPTION

Figure 1:
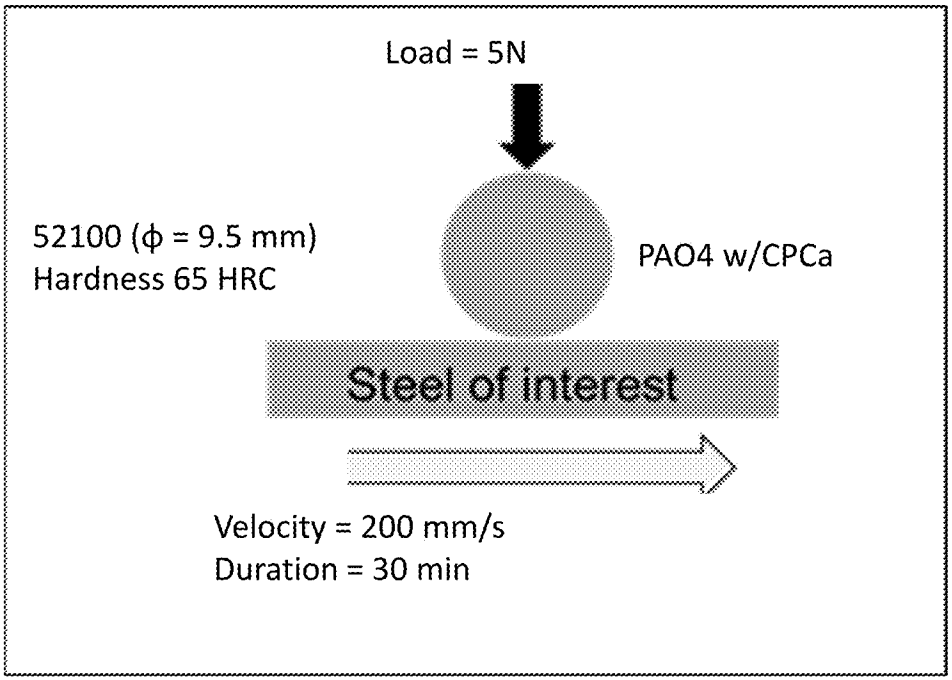
FIG. 1 is a schematic diagram of the tribotesting set-up in the Example.

Methods of pre-conditioning and lubricating the rubbing surfaces of steel substrates are provided. The methods include a pre-conditioning step in which a hydrocarbon fluid having one or more cycloalkane carboxylic acid additive dispersed therein is used to form a tribofilm on a rubbing interface formed by contacting steel surfaces of a device, following by replacing the pre-conditioning lubricant with a cycloalkane carboxylic acid-free hydrocarbon lubricant for the regular operation of the device. The tribofilm formed during the pre-conditioning step provides long-term friction and wear reduction at the interfacial rubbing surfaces, even after the cycloalkane carboxylic acid is removed, and allows for the subsequent operation of the device without the need to change the composition of the regularly used lubricant. The methods render the use of fuels as lubricants for moving parts more efficient, reduce damage to moving parts, widen the choice of lubricants for various applications, and increase the convenience of equipment usage and maintenance.

The methods can be used to reduce wear on the rubbing surfaces of moving parts in a wide variety of devices and, therefore, have uses in equipment maintenance in industrial, transportation, and military fields. The methods are particularly useful in the lubrication of equipment in applications that have restrictions on, or prohibitions against, the use of lubricant additives, as in the case of lubrication by fuels, applications in which the lubricant is subjected to adverse operating conditions and/or harsh environments, and/or in systems in which a lubricant with limited ability to generate anti-friction layers in situ is used. Examples of steel moving parts that can be maintained using the methods described herein include pumps, gear parts, transmission parts, including continuously variable transmission (CVT) parts, compressor parts, and drone parts.

The cycloalkane carboxylic acids used in the pre-conditioning step are molecules comprising a cycloalkane ring and at least one carboxylic acid (—COOH) group. Examples of cycloalkane carboxylic acids include cyclopropane carboxylic acid (CPCa), cyclobutane carboxylic acid (CBCa), cyclopropane-1,1-dicarboxylic acid (CPDCa), and cyclobutane-1,1-dicarboxylic acid (CBDCa) (collectively referred to herein as CPCa-based additives). These cycloalkane carboxylic acids have been used in lubricants for metal rubbing surfaces to catalyze the formation of tribofilms. (See, for example: Wu, Hongxing, et al. *ACS applied materials & interfaces* 11.17 (2019): 16139-16146; Ma, Qiang et al., *Tribology Letters* 68 (2020): 1-10; and U.S. Pat. No. 11,639,482.)

While the use of additives that enhance the catalysis of tribofilm formation in lubricating base fluids is known, there is little knowledge or understanding of the longer-term stability and durability of the tribofilms on steel substrates. Studies that have been published suggest that the tribofilms would be rapidly sheared away or removed instantly from the tribocontacts once the additives' replenishment is stopped. (See, for example, Morina, Ardian et al., *Journal of Physics D: Applied Physics* 40.18 (2007): 5476 and Huynh, Kim Khai, et al. *Tribology International* 184 (2023): 108476.)

The methods of the present invention are based, at least in part, on the inventors' discovery that tribofilms formed in situ on steel rubbing surfaces lubricated with hydrocarbon fluids containing cycloalkane carboxylic acids as additives have sufficient robustness and longevity to impart long-term lubricating properties, even after the cycloalkane carboxylic acid-containing base fluid is replaced by a hydrocarbon fluid that does not include the cycloalkane carboxylic acids. This stability enables the cycloalkane carboxylic acid-containing base fluids to be used in a system of device maintenance in which cycloalkane carboxylic acid is added to a base fluid (fuel) and the resulting composition is used to pre-condition one or more steel rubbing surfaces in a device as it is run (operated) for a relatively short period of time, during which a carbon-containing tribofilm is formed at the rubbing surfaces. The cycloalkane carboxylic acid-containing base fluid is then replaced by a cycloalkane carboxylic acid-free base fluid for a prolonged period of regular device operation.

During pre-conditioning, under the combined effect of flash heating and stress in steel tribocontacts, the cycloalkane carboxylic acids react with oxides on steel surfaces to form the lubricious, wear-protective carbon-containing tribofilm in situ, and these tribofilms improve the tribological performance of moving parts by lubricating their rubbing surfaces. The tribofilms are replenishable and can continuously regenerate under continuous sliding in the presence of the hydrocarbon fluid containing the cycloalkane carboxylic acids. Without intending to be bound to any theory of tribofilm formation, it is proposed that oxides, such as chromium oxides, iron oxides, and/or nickel oxides, in steel substrates act as a catalyst, facilitating the fragmentation of hydrocarbon molecules through the synergistic effects of metal cation (e.g., $Cr^{3+}$) sites and oxygen vacancies, and this fragmentation is accelerated by the cycloalkane carboxylic acids. Subsequently, the fragmented molecules polymerize, leading to the formation of the tribopolymers that attach to the steel surface.

The hydrocarbon base fluids in which the cycloalkane carboxylic acids are dispersed are hydrocarbons or mixtures of hydrocarbons. The hydrocarbon fluids may be obtained as a petroleum distillate, but may also be plant-based or synthetic. Major components of hydrocarbon base fluids commonly include dodecane, undecane, decane, tridecane, tetradecane, benzene (e.g., trimethyl benzene), nonane, pentadecane, naphthalene (e.g., dimethyl naphthalene), and various combinations thereof, as well as polyalphaolefins and similar fluids. However, the exact composition of a mixture of hydrocarbons will depend upon their source and intended use. In some embodiments of the methods, polyalphaolefin-4 (PAO4) is used as a base fluid.

The concentration of the cycloalkane carboxylic acid in the hydrocarbon fluid is typically in the range from 1 wt. % to 10 wt. %, including embodiments in which the concentration of cycloalkane carboxylic acid in the hydrocarbon base fluid is in the range from 2 wt. % to 5 wt. %. However, concentrations outside of these ranges can be used.

The brief pre-conditioning step, which has shorter duration than the operational period, makes it possible to realize the lubricating advantages of tribofilms, while enabling cycloalkane carboxylic acid-free operation and substantially reducing the use of the cycloalkane carboxylic acid additives used over the lifetime of a device. The duration of the pre-conditioning step is typically short; the duration need only be long enough to form a tribofilm and to achieve a stable coefficient of friction at the rubbing surfaces. By way of illustration, the pre-conditioning step may be carried out for a period of 60 minutes or less. In some embodiments of the methods, the pre-conditioning step is carried out for a period of 30 minutes or less, a period of 20 minutes or less, or a period of 15 minutes or less. This includes embodiments of the invention in which pre-conditioning is carried out for a period of 5 minutes to 60 minutes.

The tribofilms result in a low coefficient of friction between the rubbing surfaces. By way of illustration, coefficients of friction (COFs) of less than 0.1 are typically achieved.

During pre-conditioning, the device may be run under the same conditions (e.g., operating temperature and speed) as those used during the normal course of the device operation, or under accelerated conditions. Alternatively, the device may be operated under "accelerated" conditions, which are conditions that promote tribofilm formation. Accelerated conditions include operating the device in an ambient environment having a temperature up to 100° C. and/or increasing the speed of the device and, therefore, the rate at which the rubbing surfaces slide against each other. For example, the device and rubbing rate may be increased up to twice that of the speed used in routine device operation.

Upon completion of the pre-conditioning step, the device is stopped (i.e., the rubbing of the rubbing surfaces ceases) and the rubbing surfaces are flushed for a short duration with a hydrocarbon fluid that does not include the cycloalkane carboxylic acids. In some embodiments, the hydrocarbon fluid is not only free of all tribofilm-formation catalyzing additives (e.g., cycloalkane carboxylic acids), but it is also free of additives of any type. The hydrocarbon fluid used in the flushing may be the same as the base hydrocarbon fluid in the cycloalkane carboxylic acid-containing lubricant composition. The duration of the flush can be short. For example, flushing the rubbing surfaces for a period of 15 minutes or less, including a period of 10 minutes or less, or a period of 5 minutes or less, is generally sufficient.

Normal operation of the device, now with its rubbing surfaces coated by the cycloalkane carboxylic acid-free hydrocarbon fluid, is then commenced and continues for a prolonged period. To simplify the process, it is desirable to use the same hydrocarbon fluid during the pre-conditioning, flushing, and operation steps. The pre-conditioning and subsequent operation steps can be carried out for multiple cycles.

When the pre-conditioning step is implemented in an existing device lubrication protocol, the duration of the operational period may be the same as, or longer than, the operational period used during operation without the pre-conditioning step. The result is less friction and wear at the rubbing surfaces for the same, or longer, duration of operation. However, the duration of the operational period may be shortened upon the implementation of the pre-conditioning step to allow for periodic pre-conditioning.

The duration of the operational period may also be selected based on changes in the friction and wear performance of the rubbing surfaces of moving parts in a device. For example, normal operation can be stopped once the COF at a rubbing surface becomes unstable or increases to the COF at the rubbing surface in the absence of the pre-conditioning. Alternatively, normal operation can be stopped when the wear volume of the rubbing surface reaches a pre-established value. The rubbing surfaces can then go through the pre-conditioning step again, prior to the resumption of normal operation. (Methods and conditions for measuring the COF and wear on a surface are described in the Example.)

By way of illustration, the normal (i.e., after pre-conditioning) period may last for at least one hour, at least 5 hours, at least 10 hours, at least 30 hours, or at least 40 hours. For example, normal operation may be carried out for a period of 1 hour to 50 hours. Notably, although operation (rubbing) during these prolonged periods is carried out using a lubricant that is free of the cycloalkane carboxylic acids, the coefficient of friction between the steel surfaces can remain low and the wear rate of the steel surfaces can be decreased by a factor of at least two, relative to the wear rate of the same steel surface operated for the same duration and under the same conditions, but without the pre-conditioning step. In some embodiments of the methods, the wear rate is decreased by a factor of at least three, at least five, or more, relative to the wear rate of the same steel surface operated for the same duration and under the same conditions, but without the pre-conditioning step.

An exemplary embodiment of the methods includes the steps of: 1) adding up to 5 wt. % of one or more cycloalkane carboxylic acid additives described above to a base fluid (e.g., a fuel); 2) running the system (device) with the cycloalkane carboxylic acid-containing base fluid mentioned in step 1, lubricating the rubbing (for example, sliding or rolling) surfaces for a short periodic of time (for example, 15-60 minutes) under its normal conditions or accelerated conditions (such as higher temperature up to 100° C., or higher speed up to twice the regular speed); and 3) stopping and flushing the rubbing contacts in the system, preferably for no longer than 5 minutes, with the regular lubricant (fuel) without the cycloalkane carboxylic acid additives. The system is then ready for its next cycle of regular use, now with enhanced surface protection via previously formed tribopolymers.

A variety of steel substrates, including D2 and 52100 steels, can benefit from the pre-conditioning maintenance protocols described herein, including various steels comprising iron oxides, chromium oxides, molybdenum oxides, copper oxide, and/or nickel oxides. The methods are particularly suited for use in the maintenance of equipment having rubbing surfaces composed of steels with a high content of metal atoms that catalyze the formation of the tribofilms. For example, steels having a high Cr content, Mo content, Fe content, Ni content, or Cu content show surprisingly enhanced long-term wear-resistant benefits from the pre-treatments described herein. By way of illustration, steels having a catalytic metal content of at least 10 atomic percent. Thus, as illustrated in the example, the pre-conditioning protocols works particularly well with rubbing surfaces formed from AISI D2 steel, a high-carbon, high-chromium tool steel alloyed with molybdenum and vanadium, which typically has a chromium content of about 11 to 12 atomic percent. The use of the present methods on the high-chromium D2 steel is particularly advantageous because D2 steel has a high a surface catalytic activity, particularly with cycloalkane carboxylic acids, including CPCa, relative to other steels.

The methods can be carried out on the bare steel surfaces—that is, without the need to treat or coat the surfaces with other material, such as other metals or alloys or transitional metal carbides or nitrides, such as TiN.

EXAMPLE

This example illustrates a maintenance protocol for a device having steel rubbing surfaces, which includes a pre-conditioning step followed by an operational step. The methods are illustrated using CPCa as the cycloalkane carboxylic additive. However, the protocol described in this Example can also be carried out using CBCa, CPDCa, or CBDCa because these additives exhibit similar reactivity with even better wear protection.

Tribotesting Protocol:

The protocol was designed for reliable in-situ tribopolymerization of a base fluid at sliding interfaces via surface-active catalysis. The following procedures/testing conditions were used: 1) tribotesting conditions for a PAO4 test were matched to those for a dodecane test; 2) the fluid film thickness was estimated with elastohydrodynamic lubrication (EHL) simulations; 3) sliding speed was maintained and surface roughness was adjusted to achieve similar fluid film thickness and lubrication regime for the PAO4 and dodecane tests; 4) tribotests were conducted with dodecane using varying concentrations of CPCa; and 5) robustness and longevity of tribofilm formation were tested via a "CPCa Conditioning" protocol.

The tribotesting set-up is shown schematically in FIG. 1. The PAO4 tribotest conditions were for a polyalphaolefin-4 (PAO4) base fluid containing 2.5 wt. % CPCa on high hardness 52100 steel. The PAO4 testing conditions were as follows: 200 mm/s sliding velocity;

$$\lambda = \frac{\text{film thickness}}{\text{composite RMS roughness}} = 0.74;$$

Vertical Load: 10N; Steel: 52100 @ 60 HRC; Ra=60 nm; Hertzian Contact Pressure: 1045.2 MPa.

Data Fitting for Viscosity of PAO4 Base Fluid.

A temperature and pressure dependent model of viscosity was needed for elastohydrodynamic lubrication (EHL) simulations. The Roelands Viscosity Equation was used:

$$\eta_R(T, P) = \eta_0 e^{\left([\ln(\eta_0)+H]\left[-1+(1+5.1\times10^{-9}P)^Z\left(\frac{T+135}{T_0+135}\right)^{-S_0}\right]\right)}$$

where $\eta_R$=dynamic viscosity of the fuel

P=gauge pressure

T=temperature $T_0$=reference temperature and

Z=Roelands Viscosity-Pressure Index $S_0$=atmospheric Roelands Slope Index $\eta_0$=viscosity at $T_0$ and atmospheric pressure H=additional parameter.

The following values were used:

| Fuel | H | Z | $S_0$ | $R^2$ |
|---|---|---|---|---|
| PAO4 | 2.283 | 0.567 | 1.099 | 1 |

Figure 2:
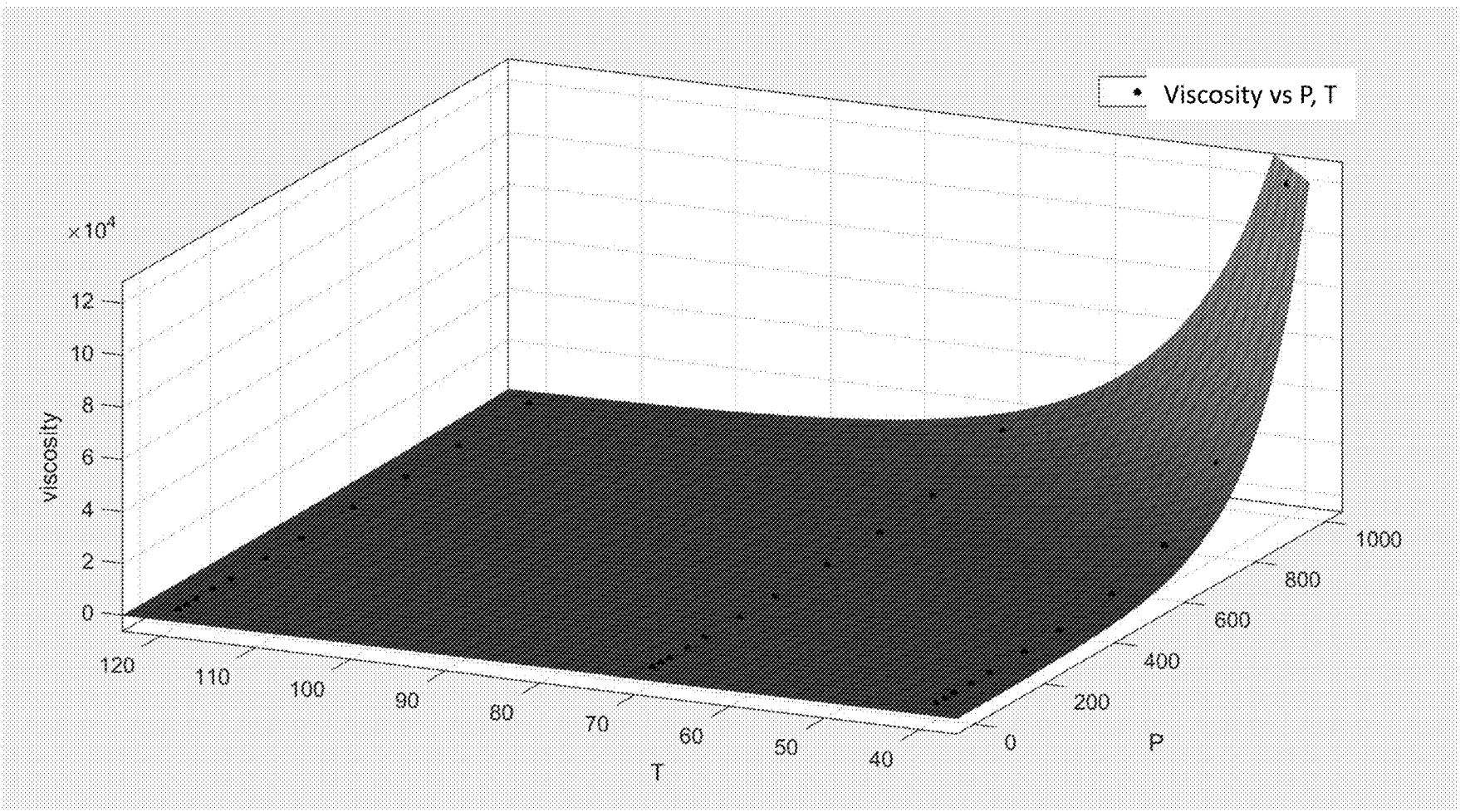
FIG. 2 shows data fitting results for the viscosity of a PAO4 base fluid, as described in the Example.

The data fitting results for viscosity of the PAO4 base fluid are shown in FIG. 2.

EHL Simulation Results:

The EHL simulation results were as follows:

PAO4

0.2 m/s, 10 N

Central Fluid Film Thickness=24.64 nm

Minimum Fluid Film Thickness=9.23 nm and

Dodecane 0.2 m/s, 0.1 N

Central Fluid Film Thickness=4.2 nm

Minimum Fluid Film Thickness=2.61 nm

Indicating:

Dodecane film thickness=⅙ PAO4 film thickness

Ra ∝ composite Rq

Reduce Ra by factor of 6→10 nm

Central film λ=0.34, minimum film λ=0.21→indicating deep mixed and boundary lubrication Having established some appropriate testing conditions, the next step was to develop a maintenance procedure to protect the steel surfaces for an extended time while operating without the CPCa additive. The approach used to meet this objective was as follows: pin-on-disk tribotesting on 52100 and D2 steels was conducted (FIG. 1), and the effects of the additive on wear and tribofilm robustness were compared; tribotesting of a lubricating composition of dodecane (as a base fluid)+CPCa was run for 15 minutes, then the container was flushed, the fluid was replaced with pure lubricant (i.e., pure dodecane without the CPCa), and the test was resumed (for a total duration of 30 minutes or 75 minutes); the wear results of the steel substrates for the testing run with and without the dodecane+CPCa pre-conditioning procedure were then compared. The tribotests are summarized in Tables 1A, 1B, 2, and 3.

TABLE 1A

| Load | Sliding Velocity | Lubricant | Additive | Hertz Pressure |
|---|---|---|---|---|
| 5N | 200 mm/s | Dodecane | CPCa | 798.3 MPa |

TABLE 1B

| Duration | Sample Hardness | Surface Roughness | Film Thickness | λ ratio |
|---|---|---|---|---|
| 30 or 75 min | 60 HRC | 10 nm | Central: 4.2 nm<br>Minimum: 2.61 | Central: 0.34<br>Minimum: 0.21 |

Figure 3:
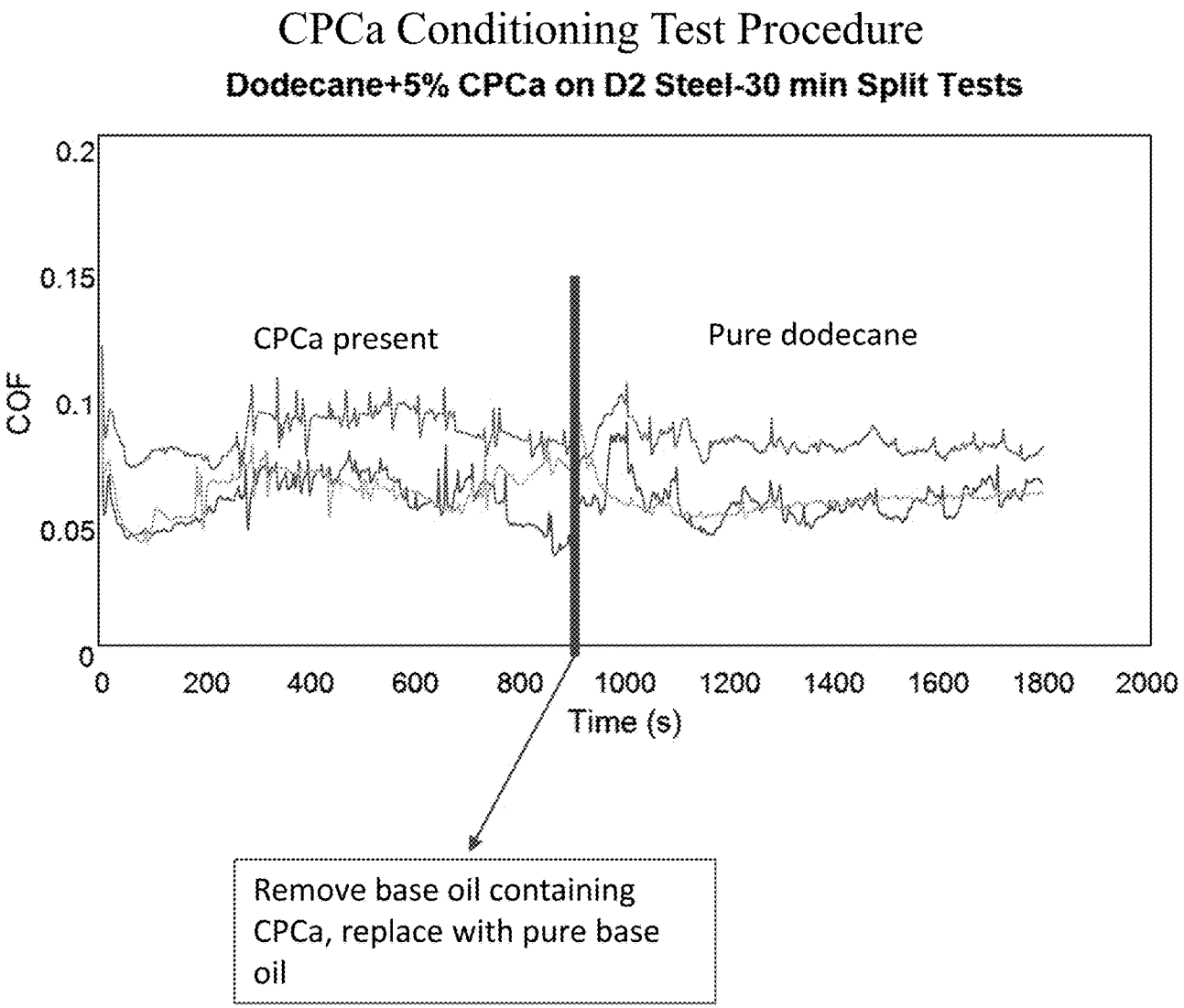
FIG. 3 shows the results of a coefficient of friction (COF) testing for a maintenance procedure that included a pre-conditioning step in which a dodecane+5 wt. % CPCa composition was used to lubricate a D2 steel surface for 15 minutes, followed by a flush with pure dodecane, and then resumption of rubbing for an additional 15 minutes.

FIG. 3 shows the results of a maintenance procedure that included a pre-conditioning step in which a dodecane+5 wt. % CPCa composition was used to lubricate the D2 steel for 15 minutes, followed by a flush with pure dodecane, and then the pin-on-disk test was resumed for an additional 15 minutes. As shown in FIG. 3, the COF did not increase for the duration of the testing, even after the CPCa-containing dodecane was replaced with pure dodecane.

Tribotesting was also run using 52100 steel and different concentrations of the CPCa, with and without the pre-conditioning step, as summarized in Table 2.

TABLE 2

| Test Groups | | | | |
|---|---|---|---|---|
| Group | Material | Duration (min) | Concentration | Conditioning (yes/no) |
| A | 52100 | 30 | 0 | No |
| B | 52100 | 30 | 5 | No |
| C | 52100 | 30 | 5 | Yes |
| D | D2 | 30 | 0 | No |
| E | D2 | 30 | 2.15 | No |
| F | D2 | 30 | 2.5 | No |
| G | D2 | 30 | 5 | No |
| H | D2 | 30 | 5 | Yes |
| I | D2 | 75 | 0 | No |
| J | D2 | 75 | 5 | Yes |

Wear coefficients were measured for the different tribotests, as shown in Table 3.

TABLE 3

| | | | |
|---|---|---|---|
| A | 52100 0% CPCa | 30 min | |
| B | 52100 5% CPCa | 30 min | |
| C | 52100 5% CPCa | 30 min | 15 min. CPCa + 15 min |
| D | D2 0% CPCa | 30 min | |
| E | D2 2.15% CPCa | 30 min | |
| F | D2 2.5% CPCa | 30 min | |
| G | D2 5% CPCa | 30 min | |
| H | D2 5% CPCa | 30 min | 15 min. CPCa + 15 min. |
| I | D2 0% CPCa | 75 min | |
| J | D2 5% CPCa | 75 min | 15 min. CPCa + 1 hr. |

Figure 4:
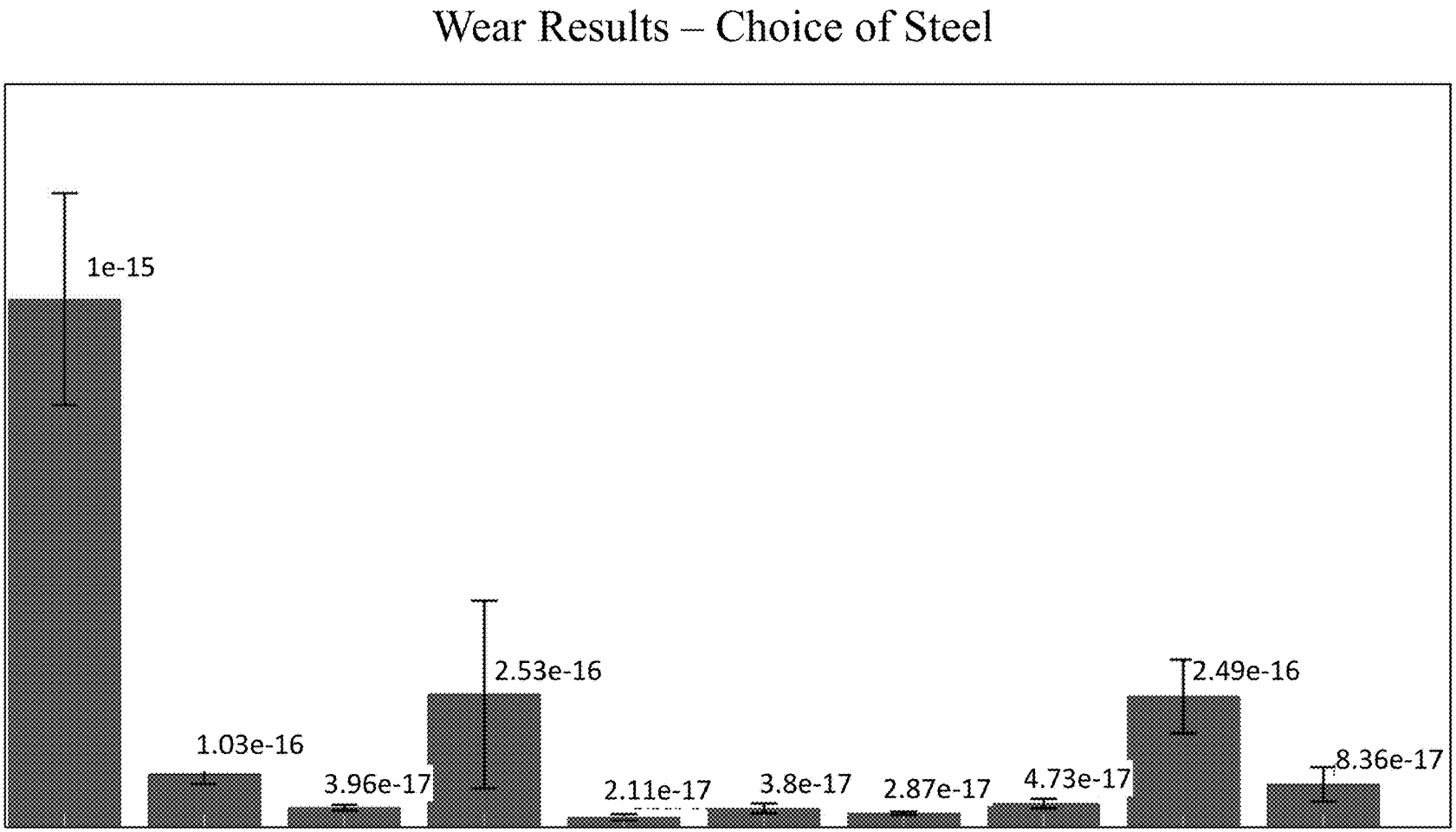
FIG. 4 shows the results of measurements of wear coefficients for different tribotests, as discussed in the Example.

The results are shown in FIG. 4. The measurements and results are summarized as follows:

$$\text{Ball wear coefficient} = \frac{\text{wear volume}}{\text{sliding distance} * \text{load}}$$

D2 steel has higher wear resistance than 52100

All CPCa tests resulted in large wear reduction

Lowest wear corresponding to 5% CPCa on D2 steel

D2 steel is chosen for the conditioning tests

Figure 5:
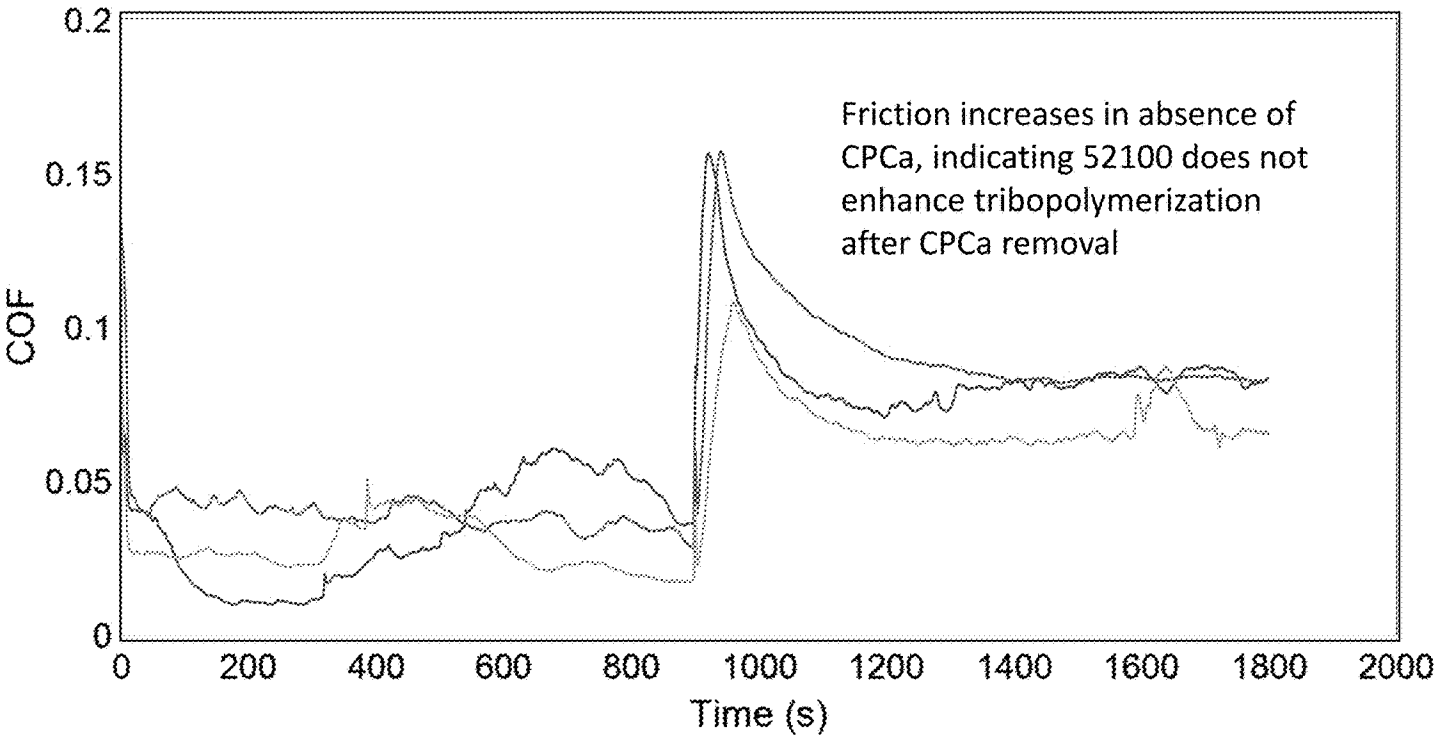
FIG. 5 shows the COF results for tribotesting using a 15-minute pre-conditioning step with dodecane+5 wt. % CPCa on 52100 steel, followed by a dodecane flush, and 15 minutes of resumed operation (rubbing) with pure dodecane.

The COF results for tribotesting using a 15-minute pre-conditioning step with dodecane+5 wt. % CPCa on 52100 steel, followed by a dodecane flush, and 15 minutes of operation with pure dodecane are shown in FIG. 5. These results show that the friction increased in the absence of the CPCa and indicate that tribopolymerization was not enhanced on the 52100 steel after CPCa was removed from the system.

Figure 6:
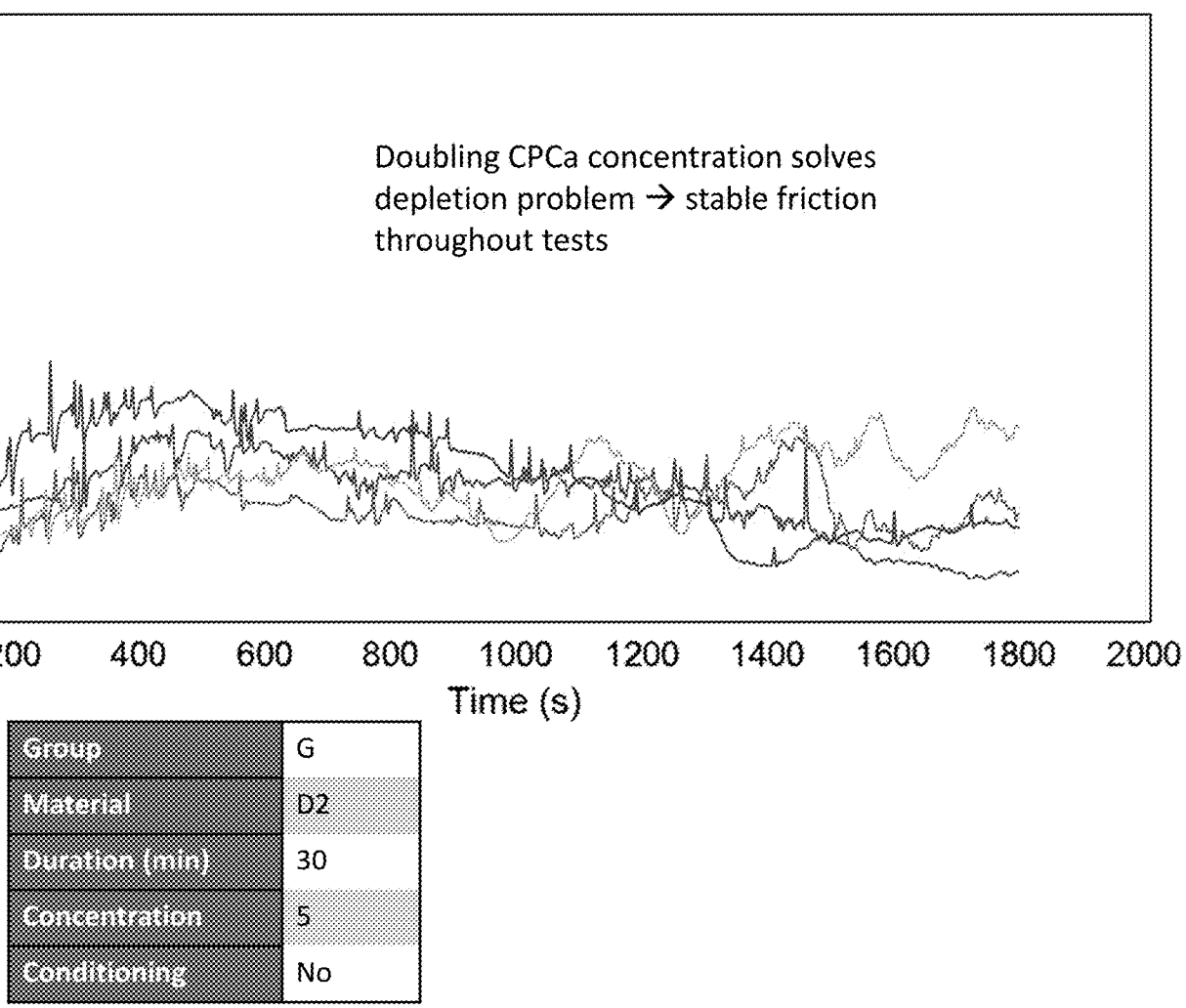
FIG. 6 shows the COF results for tribotesting on 52100 steel using dodecane without a pre-conditioning step.

The COF results for tribotesting on 52100 steel using dodecane without a pre-conditioning step are shown in FIG. 6. These results show that a stable COF was achieved throughout the test.

Figure 7:
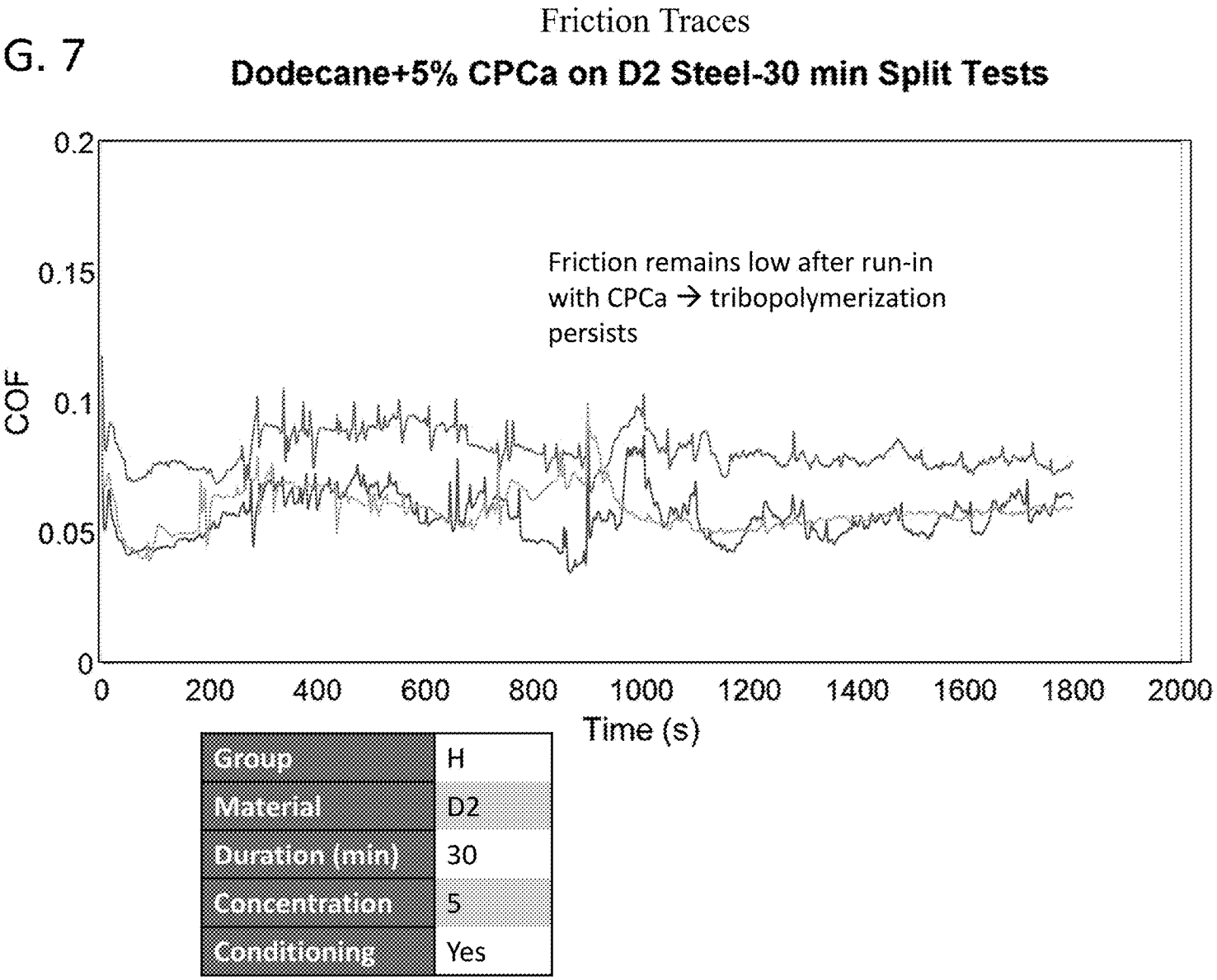
FIG. 7 shows the COF results for tribotesting using a 15-minute pre-conditioning step with dodecane+5 wt. % CPCa on D2steel, followed by a dodecane flush, and 15 minutes of operation with pure dodecane.

The COF results for tribotesting using a 15-minute pre-conditioning step with dodecane+5 wt. % CPCa on D2 steel, followed by a dodecane flush, and 15 minutes of operation with pure dodecane are shown in FIG. 7. These results show that the friction remained stable throughout the testing and indicate that tribopolymerization was enhanced on the D2 steel even after CPCa was removed from the system.

Figure 8:
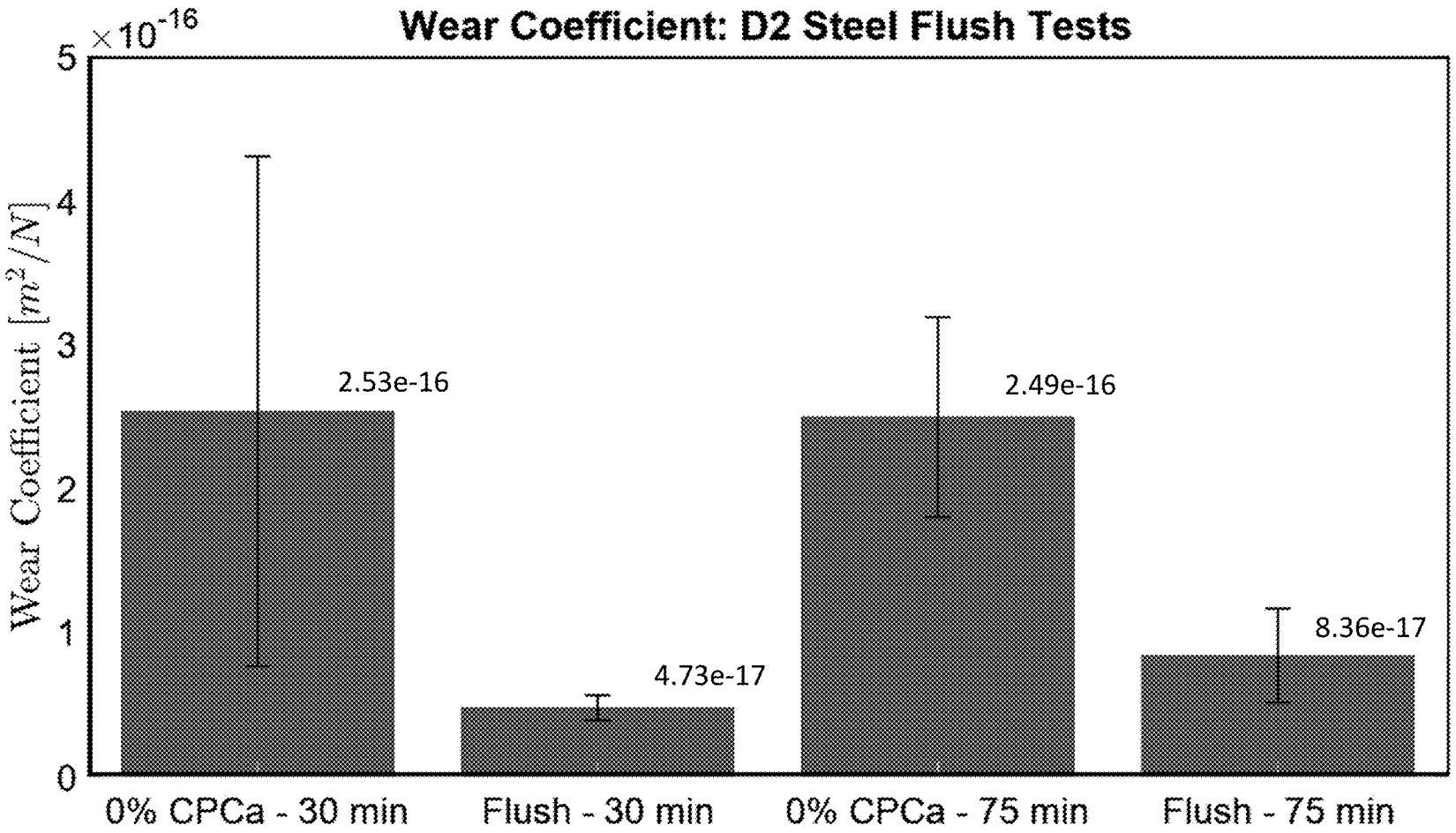
FIG. 8 shows the results for tribotests run using D2 steel lubricated with pure dodecane without a pre-conditioning step for operating step durations of 30 minutes (0% CPCa—30 min) and 75 minutes (0% CPCa—75 min) and tribotests run with a 15 minute pre-conditions step using 5 wt. % CPCa in dodecane followed by a flush and a 15 minute operation step using pure dodecane (Flush—30 min) or using 5 wt. % CPCa in dodecane followed by a flush and a 60 minute operation step using pure dodecane (Flush—75 min).

The tribotests were also run for D2 steel using pure dodecane without a pre-conditioning step for operating step durations of 30 minutes (0% CPCa—30 min) and 75 minutes (0% CPCa—75 min) and compared to tribotests run with a 15 minute pre-conditions step using 5 wt. % CPCa in dodecane followed by a flush and a 15 minute operation step using pure dodecane (Flush—30 min) or using 5 wt. % CPCa in dodecane followed by a flush and a 60 minute operation step using pure dodecane (Flush—75 min). The results, which are presented in FIG. 8, show that the CPCa produced a protective film that significantly reduced wear even after 1 hour of operation in pure dodecane after the pre-conditioning.

Figure 9B:
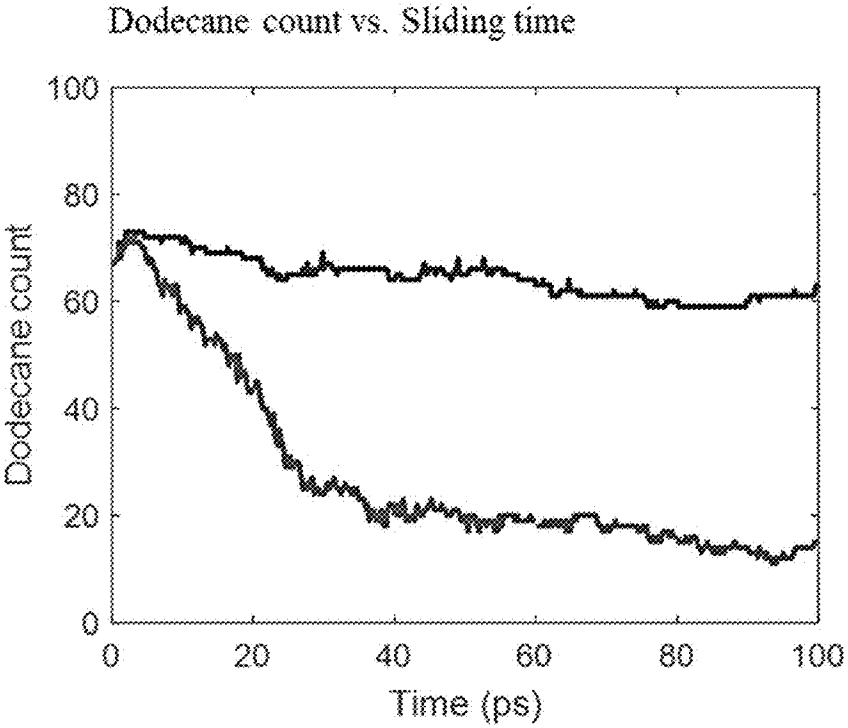
FIGS. 9A-9B show the results of Reactive MD Simulations done to verify dodecane decomposition and recombination under sliding, catalyzed by Cr-oxide, necessary for generating the protective tribofilm.
Figure 9A:
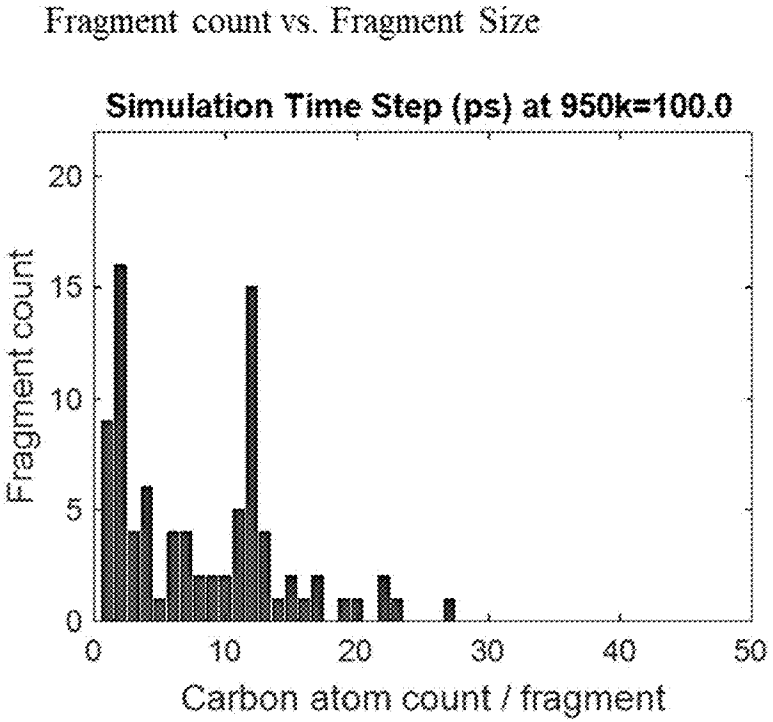
Figure 10A:
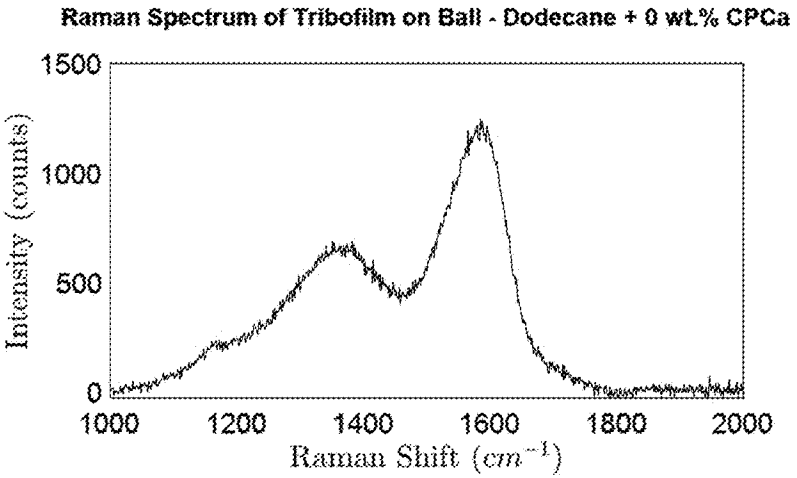
FIGS. 10A-10D show Raman spectra taken of wear scars on steel substrates ((FIG. 10A) dodecane+0 wt. % CPCa, (FIG. 10B) dodecane+2.15 wt. % CPCa, (FIG. 10C) dodecane+2.5 wt. % CPCa, (FIG. 10D) dodecane+5 wt. % CPCa).
Figure 10B:
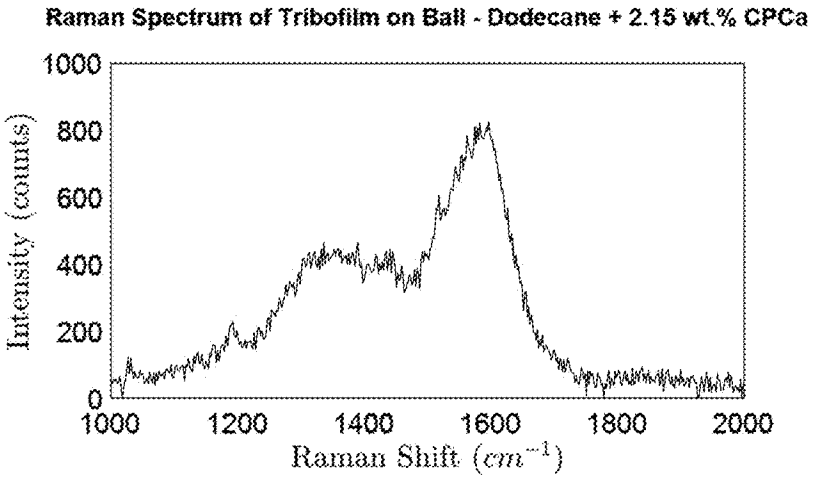
Figure 10C:
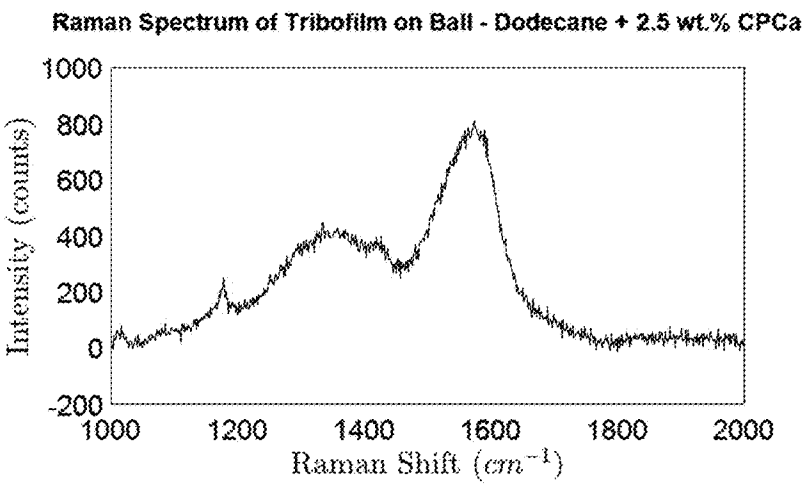
Figure 10D:
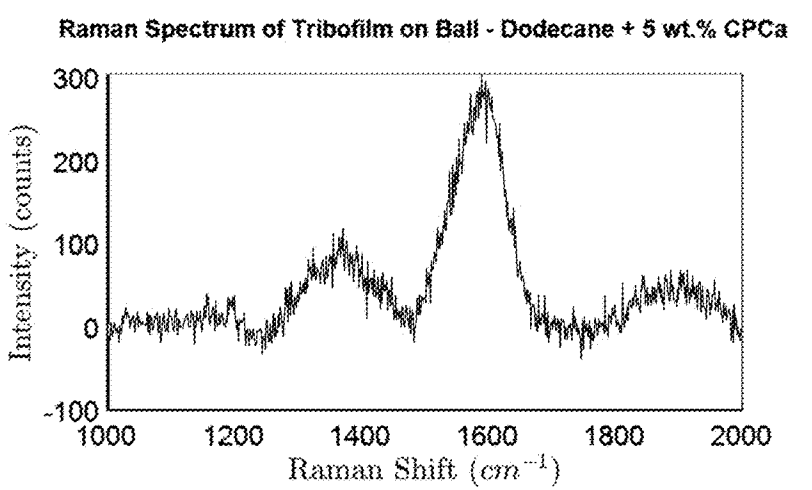
Figure 11A:
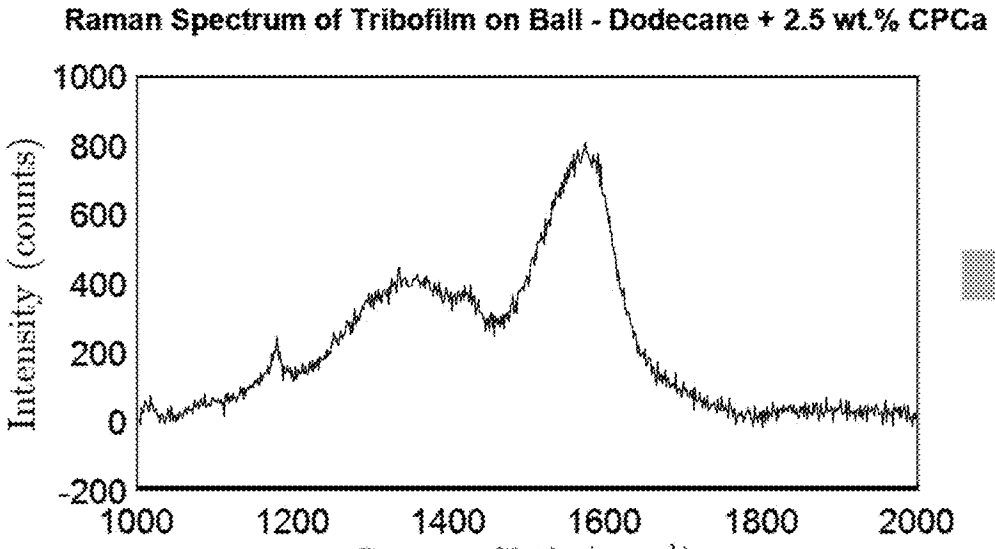
FIGS. 11A-11B show Raman spectra taken of wear scars on steel substrates ((FIG. 11A) dodecane+2.5 wt. % CPCa, (FIG. 10B) dodecane+5 wt. % CPCa—24 hr DCM soak).
Figure 11B:
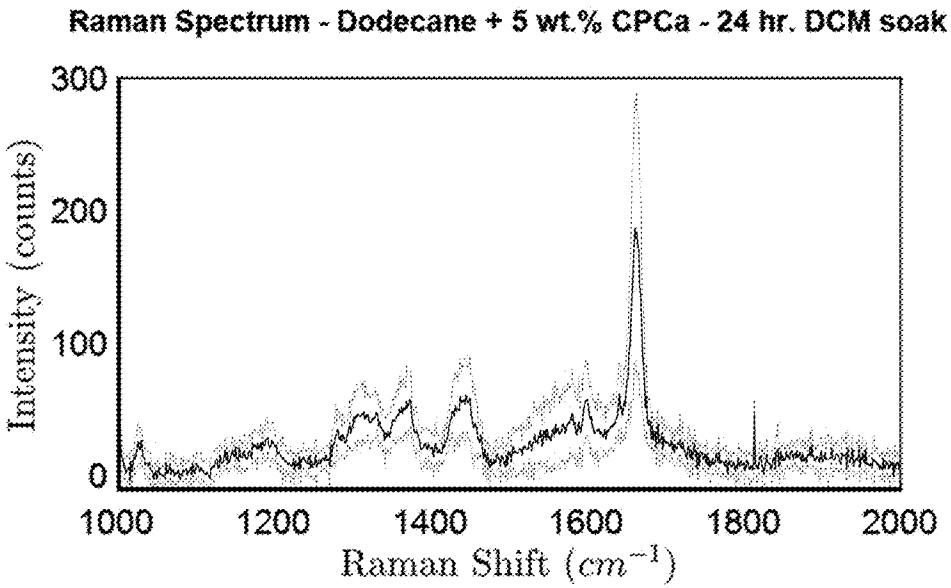

Reactive MD Simulations:

Reactive MD Simulations were done to verify dodecane decomposition and recombination under sliding, catalyzed by Cr-oxide, necessary for generating the protective tribofilm. In the simulations, dodecane and oxygen were sandwiched between two sliding substrates of chromium oxide; temperature: 950 K, sliding velocity: 10 m/s, Pressure: 2 GPa 5 molecules of oxygen, 100 molecules dodecane. The results are shown in FIGS. 9A and 9B.

Results and Conclusions: pure dodecane breaks apart; the oxygenated environment is both realistic and more conducive to polymerization initiation; decomposition of base fluid is essential for later polymerization; there was low-yield of long branched alkanes from pure dodecane, explaining that greater wear was produced if lubricated by pure dodecane; and CPCa is known to accelerate the generation and recombination of fragments via carbon radical of broken cyclopropane ring leading to higher average molecular weight and decreased wear.

Raman Spectra and Wear Scars:

Raman spectra were also taken of wear scars on the substrates. The results are shown in FIGS. 10A-10D, 11A, and 11B. The results show that tribofilm production significantly increased in the presence of the CPCa additive-verifying MD results that pure dodecane yields little tribofilm and confirming that CPCa leads to higher quantities of long-chain alkanes; wear scars were much larger under pure dodecane due to low yield of tribochemical reaction; the tribofilms were composed of carbon, as indicated by D & G bands in the Raman spectroscopy. All spectra indicated carbon tribofilm D & G peaks comparable to previous works; the tribofilms were soluble in dichloromethane (DCM) and, therefore, the tribopolymers were not diamond-like carbon (DLC).

Key Findings.

Ball wear coefficient reduction factors are shown in Table 4.

TABLE 4

| | |
|---|---|
| 0% CPCa: D2 vs. 52100 | 4 |
| 52100: 5% CPCa vs. 0% CPCa | 9.7 |
| D2: 5% CPCa vs. 0% CPCa | 8.8 |
| 75 min CPCa conditioning test on D2 vs. 30 mins of pure dodecane on D2 | 3 |
| 75 min CPCa conditioning test on D2 vs. 30 mins of pure dodecane on 52100 | 12 |

Conclusions: conditioning with CPCa for 15 min followed by operation for 1 hr with pure dodecane on D2 yields 12 times less wear than 30 min of operation using pure dodecane on 52100; the 75 min test, which included 15 minutes of pre-conditioning, yielded only twice the wear of the 30 min test, which included 15 minutes of pre-conditioning—despite sliding for 4 times longer duration after conditioning; CPCa results in significantly more tribofilm formation compared with pure dodecane—even after conditioning with the additive for just 15 mins. CPCa conditioning leads to continued wear protection under normal operation conditions using additive-free dodecane as the lubricant.

Extended Duration Testing.

The durability of tribofilms formed on 52100 steel and D2 steel pre-conditioned with 5 wt. % CPCa in dodecane over longer periods was tested. Operational periods of 15 minutes, 7 hours and 45 minutes, and 39 hours and 45 minutes after a 15-minute pre-conditioning and a short flush with dodecane were tested. (Thus, the total durations of the tests were 30 minutes, 8 hours, and 40 hours.) Ball-on-disk testing was used; the ball was made of 52100 steel and the disk was made of either 52100 or D2 steel. The testing conditions were as follows: 65 HRC; $\phi$=9.5 mm; load=5N; sliding velocity=200 mm/s; surface roughness=10 nm (disk) and 12 nm (ball).

Figure 12A:
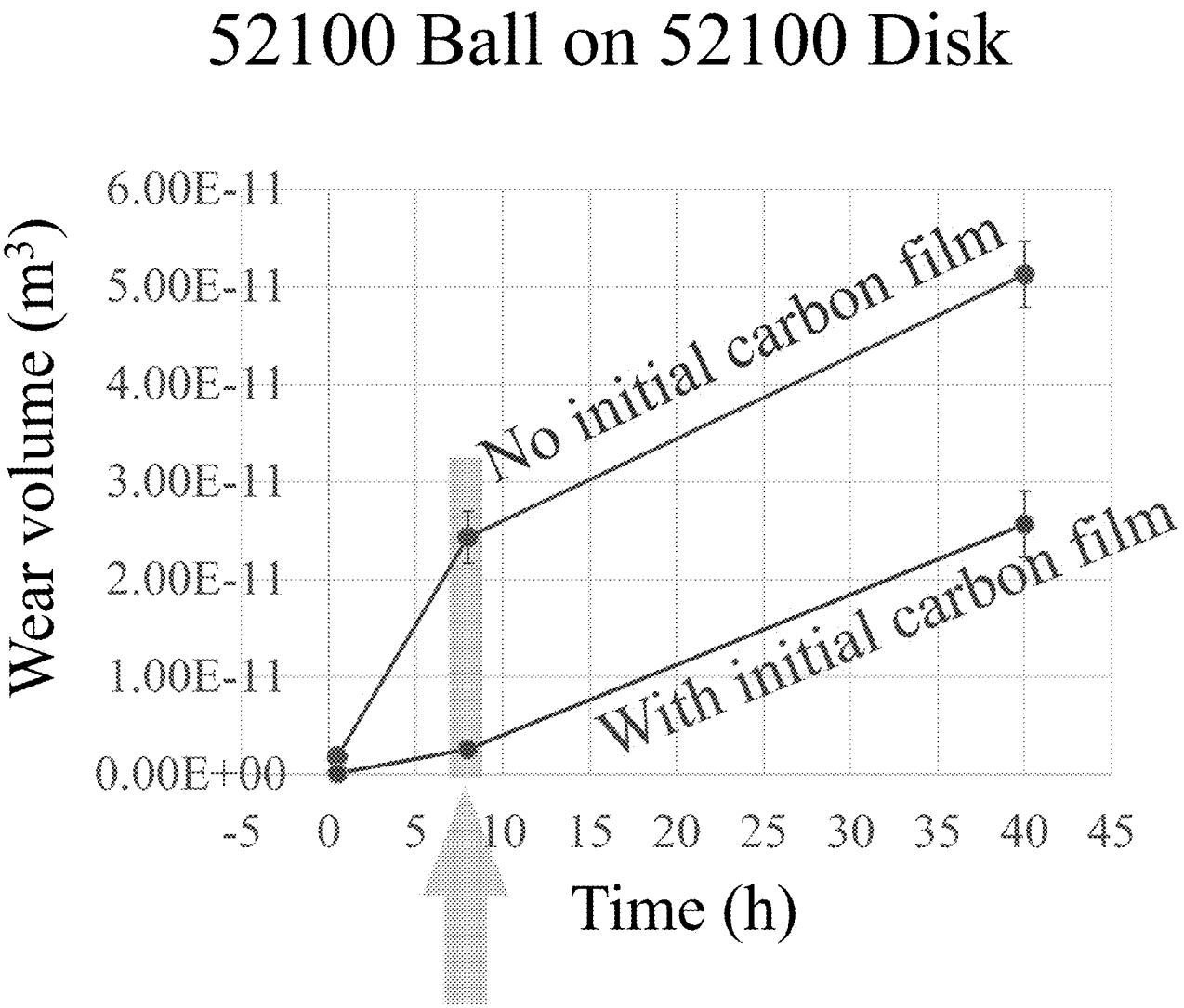
FIGS. 12A and 12B show long duration wear volume measurements for a 52100 steel disk with and without pre-conditioning (FIG. 12A) and for a D2 steel disk with and without pre-conditioning (FIG. 12B).
Figure 12B:
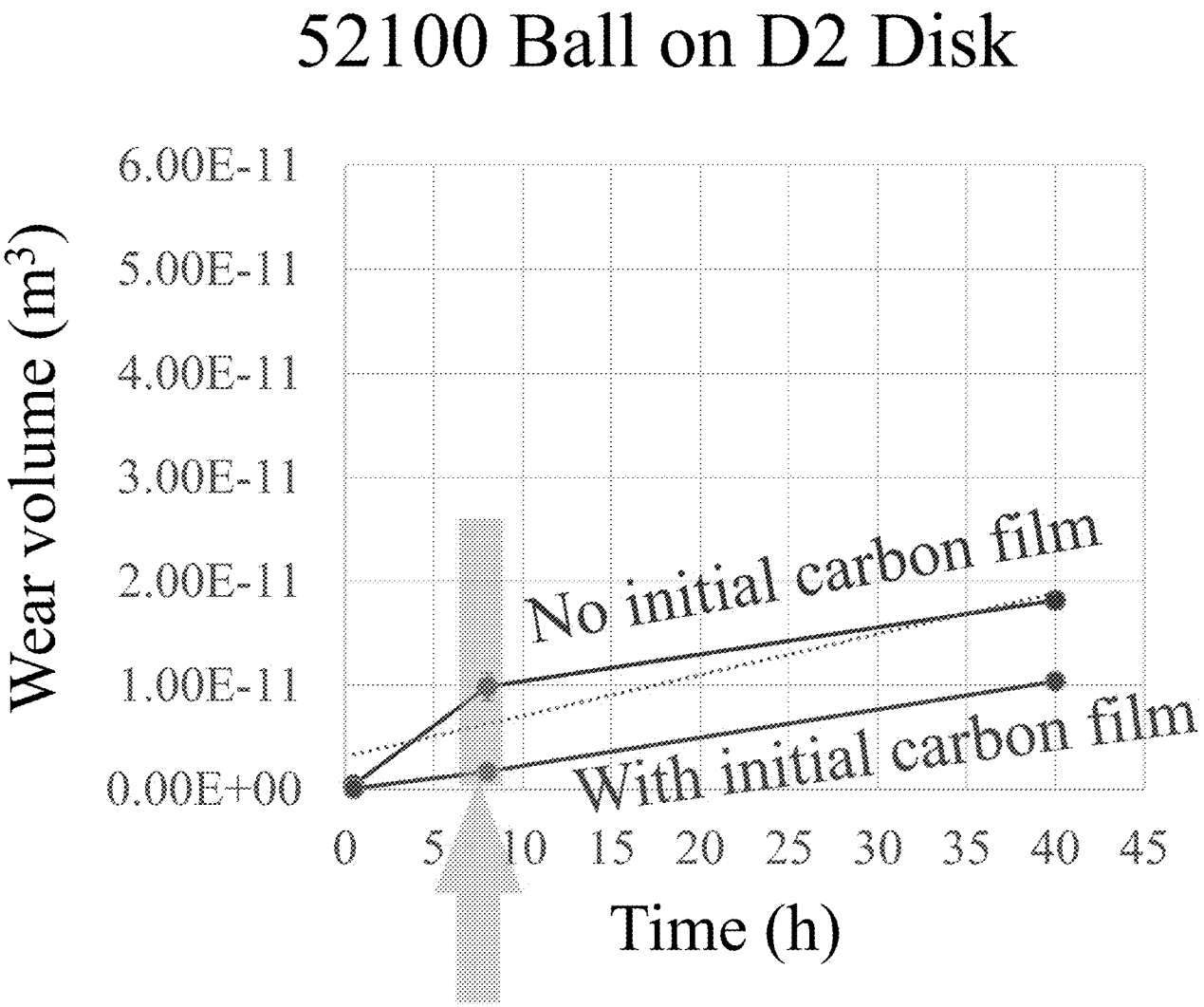

The results of wear volume measurements are shown in FIGS. 12A (52100 steel disk with and without pre-conditioning) and 12B (D2 steel disk with and without pre-conditioning). The results show that for the 52100 steel disk: pre-conditioning with CPCa in dodecane for 15 minutes, followed by normal operation for 7 h:45 min in pure dodecane, yielded 9.5 times less ball specimen wear than without pre-conditioning; and pre-conditioning with CPCa in dodecane for 15 minutes, followed by normal operation for 39 h:45 min in pure dodecane, yielded two times less ball specimen wear than without pre-conditioning. For the D2 steel disk: pre-conditioning with CPCa in dodecane for 15 minutes, followed by normal operation for 7 h:45 min in pure dodecane, yielded 5.7 times less ball specimen wear than without pre-conditioning; and pre-conditioning with CPCa in dodecane for 15 minutes, followed by normal operation for 39 h:45 min in pure dodecane, yielded 1.75 times less ball specimen wear than without pre-conditioning. Overall, pre-conditioning of the D2 with CPCa for 15 min, then running (operating) for 7 h:45 min in pure dodecane, yielded 14 times less ball specimen wear than for the 52100 without pre-conditioning.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more."

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A method of lubricating a steel surface, the method comprising:

applying a composition comprising a cycloalkane carboxylic acid dissolved in a hydrocarbon fluid lubricant to a steel rubbing interface between a first steel surface and a second steel surface;

rubbing the first steel surface against the second steel surface at the rubbing interface for a pre-conditioning period, whereby a tribofilm is formed via dissociation of the hydrocarbon into fragments and subsequent re-polymerization of the fragments;

flushing the rubbing interface using a cycloalkane carboxylic acid-free hydrocarbon for a flush period; and subsequently resuming the rubbing of the first steel surface against the second steel surface in the presence of the cycloalkane carboxylic acid-free hydrocarbon for a period of operation lasting at least 60 minutes.

2. The method of claim 1, wherein at least one of the first and second steel surfaces is composed of a steel having a chromium, molybdenum, or copper content of at least 1 atomic percent.

3. The method of claim 1, wherein at least one of the first and second steel surfaces is composed of a steel having a chromium, molybdenum, or copper content of at least 10 atomic percent.

4. The method of claim 3, wherein at least one of the first and second steel surfaces is composed of D2 steel.

5. The method of claim 1, wherein at least one of the first and second steel surfaces is composed of 52100 steel.

6. The method of claim 1, wherein the pre-conditioning period is no longer than 60 minutes.

7. The method of claim 6, wherein the flush period is no greater than 10 minutes.

8. The method of claim 7, wherein the period of operation is at least 2 hours.

9. The method of claim 1, wherein the period of operation is at least 7 hours.

10. The method of claim 1, wherein the cycloalkane carboxylic acid comprises cyclopropane carboxylic-acid, cyclobutane carboxylic acid, cyclopropane-1,1-dicarboxylic acid, or cyclobutane-1,1-dicarboxylic acid.

11. The method of claim 1, wherein the cycloalkane carboxylic acid comprises the cyclopropane carboxylic-acid.

12. The method of claim 10, wherein the first and second steel surfaces are D2 steel surfaces.

13. The method of claim 12, wherein the pre-conditioning period is no longer than 30 minutes, the flush period is no greater than 10 minutes, and the period of operation is at least 2 hours.

14. The method of claim 13, wherein the period of operation is at least 10 hours.

15. The method of claim 12, wherein the hydrocarbon fluid is a polyalphaolefin fluid.

16. The method of claim 1, wherein the hydrocarbon fluid is a polyalphaolefin fluid.

17. The method of claim 1, wherein the pre-conditioning period is no longer than 30 minutes, the flush period is no greater than 10 minutes, and the period of operation is at least 2 hours.

* * * * *